US006318949B1

(12) United States Patent
Seaberg

(10) Patent No.: US 6,318,949 B1
(45) Date of Patent: Nov. 20, 2001

(54) CLAMP FOR HANDLING STACKED LOADS OF DIFFERENT SIZES

(75) Inventor: Richard D. Seaberg, Brush Prairie, WA (US)

(73) Assignee: Cascade Corporation, Fairview, OR (US)

( * ) Notice: Subject to any disclaimer, the term of this patent is extended or adjusted under 35 U.S.C. 154(b) by 0 days.

(21) Appl. No.: 09/611,796

(22) Filed: Jul. 7, 2000

(51) Int. Cl.[7] ..... B66F 9/18

(52) U.S. Cl. ..... 414/623; 294/88; 294/87.1; 294/87.22; 901/37; 414/620; 37/519

(58) Field of Search ..... 414/607, 21, 620, 414/621, 623, 911; 294/87.1, 88, 87.22, 119.4; 901/37; 91/511, 517, 519

(56) References Cited

U.S. PATENT DOCUMENTS

| | | | | |
|---|---|---|---|---|
| 3,314,555 | | 4/1967 | Baker et al. . | |
| 4,318,661 | | 3/1982 | Helm . | |
| 4,435,117 | * | 3/1984 | House | 414/620 |
| 4,682,931 | | 7/1987 | House . | |
| 5,984,617 | | 11/1999 | Seaberg . | |
| 6,027,302 | * | 2/2000 | Nilsson | 414/621 |

FOREIGN PATENT DOCUMENTS 7-12920 2/1995 (JP) .

OTHER PUBLICATIONS

"Auramo RC–250J," 1 page (1976).
"Yamakawa Detent Linkage," 3 pages (1990).
"Cascade Japanese Pin–in–Socket Linkage," 2 pages (1990).

* cited by examiner

*Primary Examiner*—Frank E. Werner
(74) *Attorney, Agent, or Firm*—Chernoff, Vilhauer, McClung & Stenzel

(57) ABSTRACT

A lift truck clamp for handling stacked loads of different sizes has a pair of opposing clamping assemblies, one of which has a pair of clamp arms movable selectively toward and away from the other clamping assembly under the control of a pair of fluid power actuators. A linkage mechanism interconnects the pair of clamp arms so as to permit relative movement therebetween to enable the clamp arms to move asynchronously toward the other clamping assembly. The linkage mechanism includes a stop assembly preventing more than a predetermined misalignment of the pair of clamp arms, and a spring assembly imposing a yieldable biasing force biasing the pair of clamp arms toward alignment with respect to each other.

16 Claims, 4 Drawing Sheets

CLAMP FOR HANDLING STACKED LOADS OF DIFFERENT SIZES

BACKGROUND OF THE INVENTION

The present invention is directed to an improved load-handling clamp capable of handling two or more stacked loads of limited differing sizes, such as vertically-stacked abbreviated-length paper rolls of limited differing diameters. The clamp is also useful for handling stacked paper rolls of approximately the same diameter which, due to winding variations, cannot be handled by a solid arm clamp.

Such load-handling clamps normally consist of at least a pair of separately-actuated clamp arms on one side of the clamp, in opposed relation to a single, larger clamp arm on the opposite side of the clamp. The separately-actuated clamp arms are powered by separate hydraulic actuators connected in parallel to a source of pressurized fluid, and give the clamp the ability to apply clamping force separately to multiple cylindrical objects of different diameters stacked one atop the other. Similar clamping capabilities can also be useful with respect to other types of loads, such as stacked bales or cartons of different sizes.

A common problem with such a clamp is misalignment of the separately-actuated clamp arms due to different frictional resistances in the respective arm mechanisms as they close or open. If the clamp arms are misaligned to any extent, their combined profile will usually be thicker than normal. If the operator is unaware of such a misalignment the clamp arms can strike a paper roll located inside the arms, or adjacent rolls located outside the arms, as the arms are inserted or withdrawn in the course of engaging or depositing a paper roll, causing substantial damage to the roll or rolls. Correction of such misalignment often necessitates opening or closing the clamp arms to their maximum extent to realign them, which is time consuming and requires operating space which may not be available.

A related problem is that, if only a single abbreviated-length roll or other single load is to be handled, clamping pressure on the load-engaging clamp arm cannot be attained until the other separately-actuated arm or arms are closed to their maximum extent. Conversely, opening of the clamp arms sometimes requires full opening of one clamp arm before another can be released sufficiently to disengage a load. In either case, the resultant high degree of misalignment of the clamp arms maximizes the time and space requirements for operating the clamp.

U.S. Pat. No. 4,682,931 offers a partial solution to these prior problems by providing a flow regulator of the divider/combiner type which requires the respective movements (or lack thereof) of a pair of clamp arms during closing and opening to be simultaneous until the regulator is overridden, after which nonsimultaneous movement of the clamp arms is enabled. U.S. Pat. No. 5,984,617 improves on this system by making it compatible with manually-selectable predetermined clamping force adjustment systems. However, such flow-regulating solutions for controlling the movements of the pair of clamp arms cannot adequately keep the clamp arms aligned under all circumstances, due to inaccuracies in the flow regulator. Moreover, after the regulator has been overridden, the arms must be opened or closed fully to realign them. Another problem with flow regulation is that such a control system is not readily compatible with modern adaptive clamping systems, i.e., systems which automatically control the maximum fluid clamping pressure in relation to the sensed weight of the load to be clamped, to avoid overclamping of the load.

Mechanical, rather than flow-regulating, solutions to the foregoing problems of synchronizing the movements of separately-actuated clamp arms have been attempted in the past. These alternative solutions interconnect the separately-actuated clamp arms by means of mechanical linkages which permits only a limited range of movement between the clamp arms. Such mechanical linkages include simple flexible or articulated tether-type links, or mechanical or hydraulic balance-beam links, which prevent more than a predetermined misalignment of the clamp arms. These linkages, however, share the common problem that they do not automatically correct misalignment of the clamp arms to minimize their combined thickness, nor do they always avoid striking a single load engaged by one of the clamp arms when the other clamp arm is not engaging a load.

Other previous linkage mechanisms include a spring-biased detent assembly tending to hold separately-actuated clamp arms in alignment with each other, but allowing large deviations from alignment whenever the spring-biased holding force of the detent is overcome by the fluid power actuators of the clamp arms. Such an arrangement provides neither adequate limitations on the misalignment of the clamp arms, nor sufficient correction of such misalignment. Moreover, when only a single abbreviated-length load is to be handled, clamping pressure on the load-engaging clamp arm cannot be attained until the other clamp arm is fully closed.

BRIEF SUMMARY OF THE INVENTION

The present invention overcomes the foregoing deficiencies of prior load-handling clamps, for applications involving limited size differences of the stacked loads, by providing an improved linkage mechanism interconnecting the separate fluid-actuated clamp arms.

According to one preferred aspect of the invention, the linkage mechanism permits relative movement between adjacent clamp arms to permit them to move asynchronously, but includes a stop assembly preventing more than a predetermined misalignment of the clamp arms with respect to each other, as well as a spring assembly imposing a yieldable biasing force biasing the clamp arms toward alignment with respect to each other.

According to a separate preferred aspect of the invention, a linkage mechanism is provided which comprises a linkage arm movable with the clamp arms and connected between the clamp arms.

According to another separate preferred aspect of the invention, a fluid transfer conduit assembly interconnects the separate fluid-power actuators to permit the transfer of fluid therebetween in response to the biasing force of the spring assembly.

According to a still further separate preferred aspect of the invention, the stop assembly cooperates with an adaptive clamping pressure control system which automatically limits operating fluid clamping pressures variably depending upon the weight of the clamped load.

The present invention is applicable to a pair of separately-actuated clamp arms, or to a greater number of such arms as used, for example, in tower clamps.

The foregoing and other objectives, features, and advantages of the invention will be more readily understood upon consideration of the following detailed description, taken in conjunction with the accompanying drawings.

DETAILED DESCRIPTION OF THE PREFERRED EMBODIMENT

Figure 1:
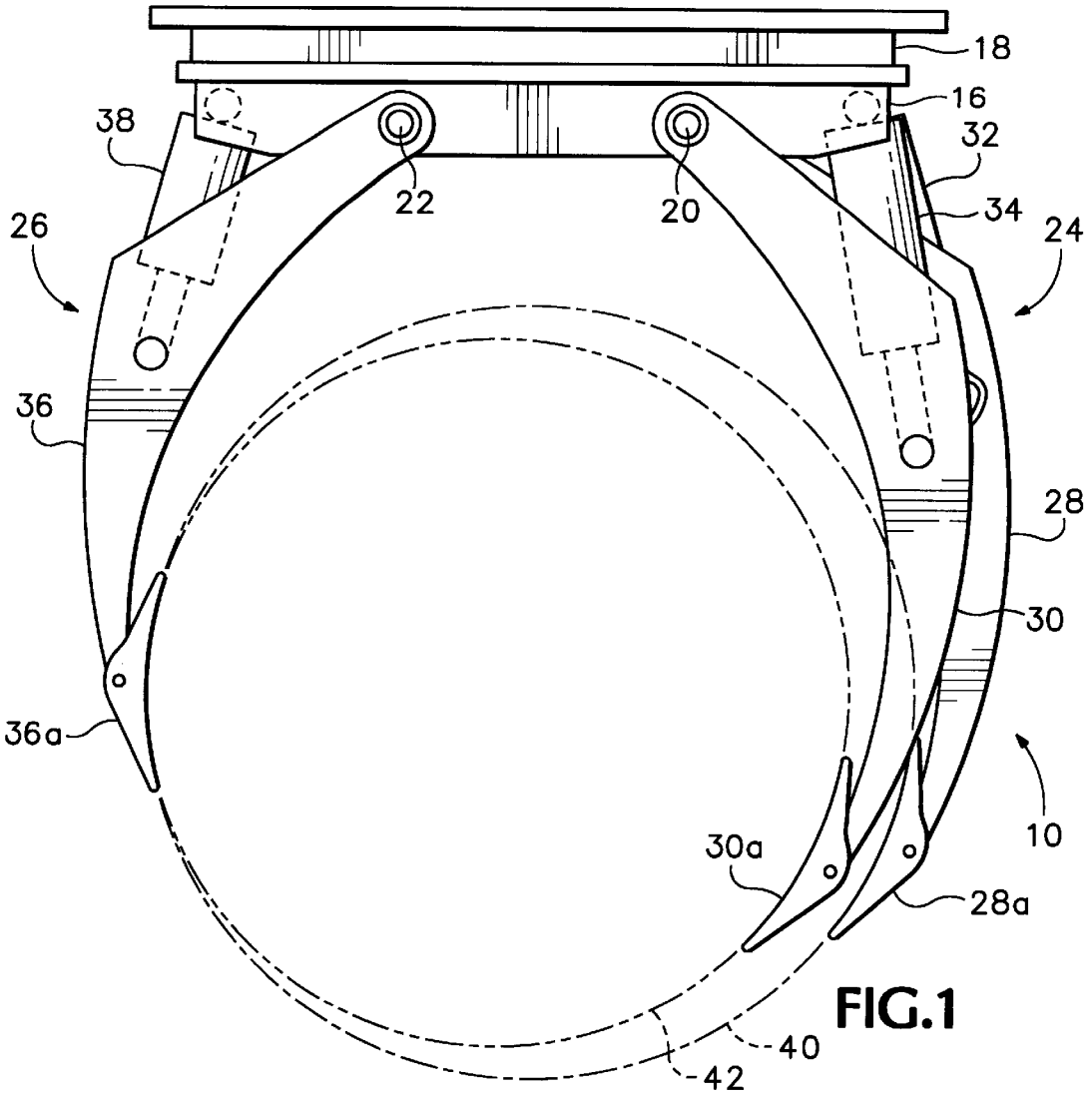
FIG. 1 is a simplified top view of an exemplary paper roll clamp embodying the present invention, shown in engagement with a pair of stacked rolls of different diameters.
Figure 2:
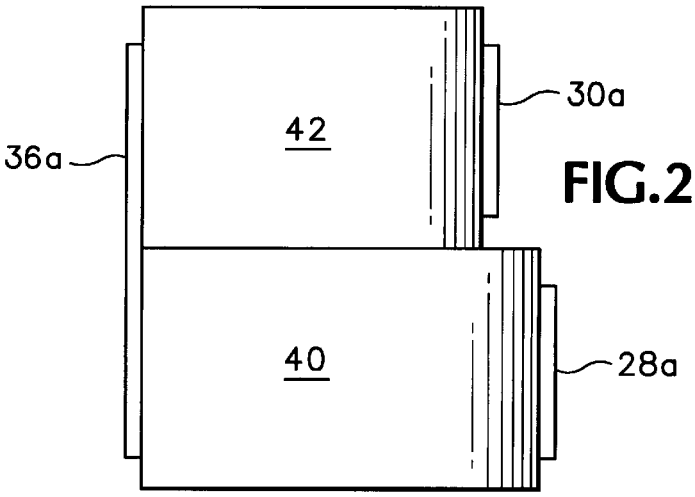
FIG. 2 is a reduced, simplified front view of the embodiment of FIG. 1.

An exemplary paper roll clamp, designated generally as 10 in FIG. 1, comprises a frame 16 which can be mounted to the load carriage of a lift truck (not shown) either fixedly or by a rotator assembly 18. Pivotally mounted to the frame 16 at pivot pins 20, 22 are a pair of opposing clamping assemblies designated generally as 24 and 26. Alternatively, the clamping assemblies could be slidably mounted to the frame 16. The clamping assembly 24 comprises a pair of vertically-spaced clamp arms 28 and 30, having respective load-engagement pads 28*a* and 30*a*, movable separately from each other relative to the frame 16 selectively toward and away from the opposing clamping assembly 26 under the control of fluid power actuators 32 and 34 respectively. Each actuator 32 and 34 consists of a double-acting hydraulic cylinder connected between the frame 16 and the respective clamp arms 28 or 30. The opposing clamping assembly 26, on the other hand, consists of only a single clamp arm 36 having an elongated load-engagement pad 36*a* extending vertically so as to oppose the pads of both of the clamp arms 28 and 30. The clamp arm 36 may move with respect to the frame under the control of one or more further fluid power actuators such as 38. Alternatively, the arm 36 could be fixed with respect to the frame 16.

The purpose of the exemplary load clamp 10 is to engage multiple, stacked, half-length paper rolls such as 40 and 42 of varying different diameters so as to transport them from one location to another. Modified versions of the clamp 10 could alternatively be used for other types of stacked loads of different sizes, such as stacked cartons or bales. It is also necessary that the clamp be capable of engaging and carrying only a single load is desired, such as roll 40. Carrying of the rolls requires that each be engaged with sufficient clamping force, by the respective pads 28*a*, 30*a* and 36*a*, to be able to support the weight of the loads vertically. The clamping force with respect to pads 28*a* and 30*a* is supplied by the pressure of hydraulic fluid tending to extend hydraulic cylinders 32 and 34, respectively.

Figure 7:
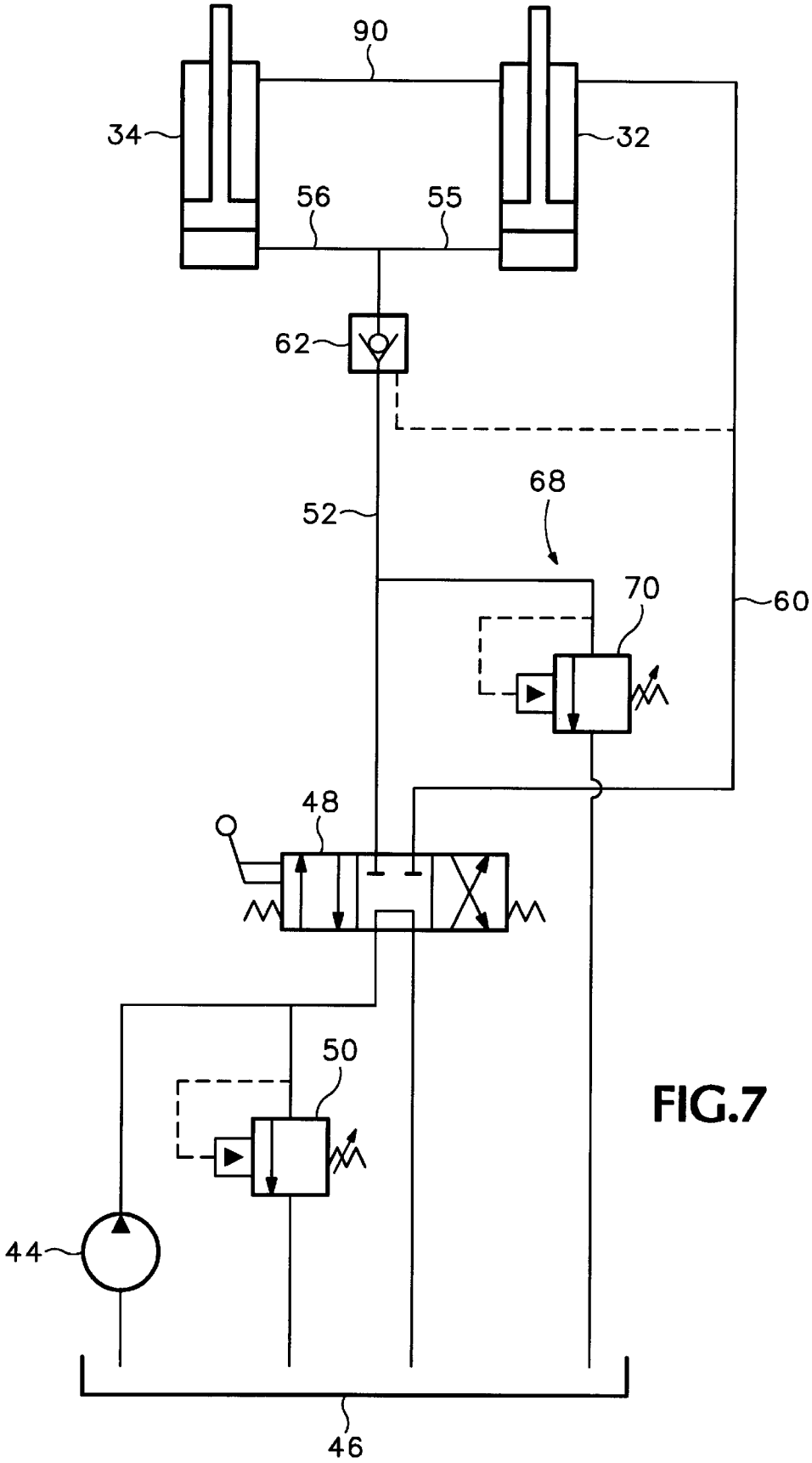
FIG. 7 is a simplified exemplary hydraulic circuit diagram for operating the clamp arms of the embodiment of FIG. 1.

With respect to the exemplary hydraulic circuit of FIG. 7, a hydraulic pump 44, driven by the lift truck engine, delivers fluid under pressure from a hydraulic reservoir 46 to a manually-operable directional control valve 48 shown in its centered, or unactuated, condition. A relief valve 50 sets an upper limit on the pressure of the fluid delivered by pump 44 by opening and bleeding fluid back to the reservoir 46 in response to excessive fluid pressure, as determined by the variable pressure setting of the relief valve 50.

Closing the clamp arms 28 and 30 is accomplished by the lift truck operator's manipulation of valve 48 to move its spool to the right in FIG. 7. This delivers pressurized fluid through an input conduit 52 to conduits 55 and 56, which deliver the fluid in parallel to the hydraulic cylinders 32 and 34 to extend the cylinders. Simultaneously, fluid is exhausted from the opposite sides of the cylinders 32 and 34 through an exhaust conduit 60 and valve 48 to the reservoir 46.

Opening the clamp arms 28 and 30 is accomplished by moving the spool of the valve 48 to the left in FIG. 7, which conducts pressurized fluid from the pump 44 through the valve 48 and the conduit 60 to retract the cylinders 32 and 34. Simultaneously, fluid is exhausted from the cylinders through parallel conduits 55 and 56 and through a pilot-operated check valve 62 which is opened by the pressure in line 60. The fluid exhausts through conduit 52 and valve 48 to the reservoir 46.

A pressure-limiting valve assembly 68, which preferably comprises one or more pressure-relief valves such as 70, is connected to the input conduit 52 to variably limit the clamping pressure in conduit 52 for different types and/or weights of loads. The valve assembly 68 could alternatively include one or more pressure-reducing valves. The pressure limit of the valve assembly 68 can be varied manually by the operator or, alternatively, automatically by an adaptive system capable of varying the pressure limit in response to the sensed weight of a load clamped between the opposing clamp assemblies 24 and 26. An example of such an adaptive system is shown in U.S. patent application Ser. No. 09/388,181, filed Sep. 1, 1999, which is incorporated herein by reference. Such a system automatically adjusts the maximum clamping force to that which is necessary to lift a load of the particular weight sensed, either during initial lifting of the load or, preferably, both during initial lifting and thereafter while the load is being handled by the lift truck.

Figure 3:
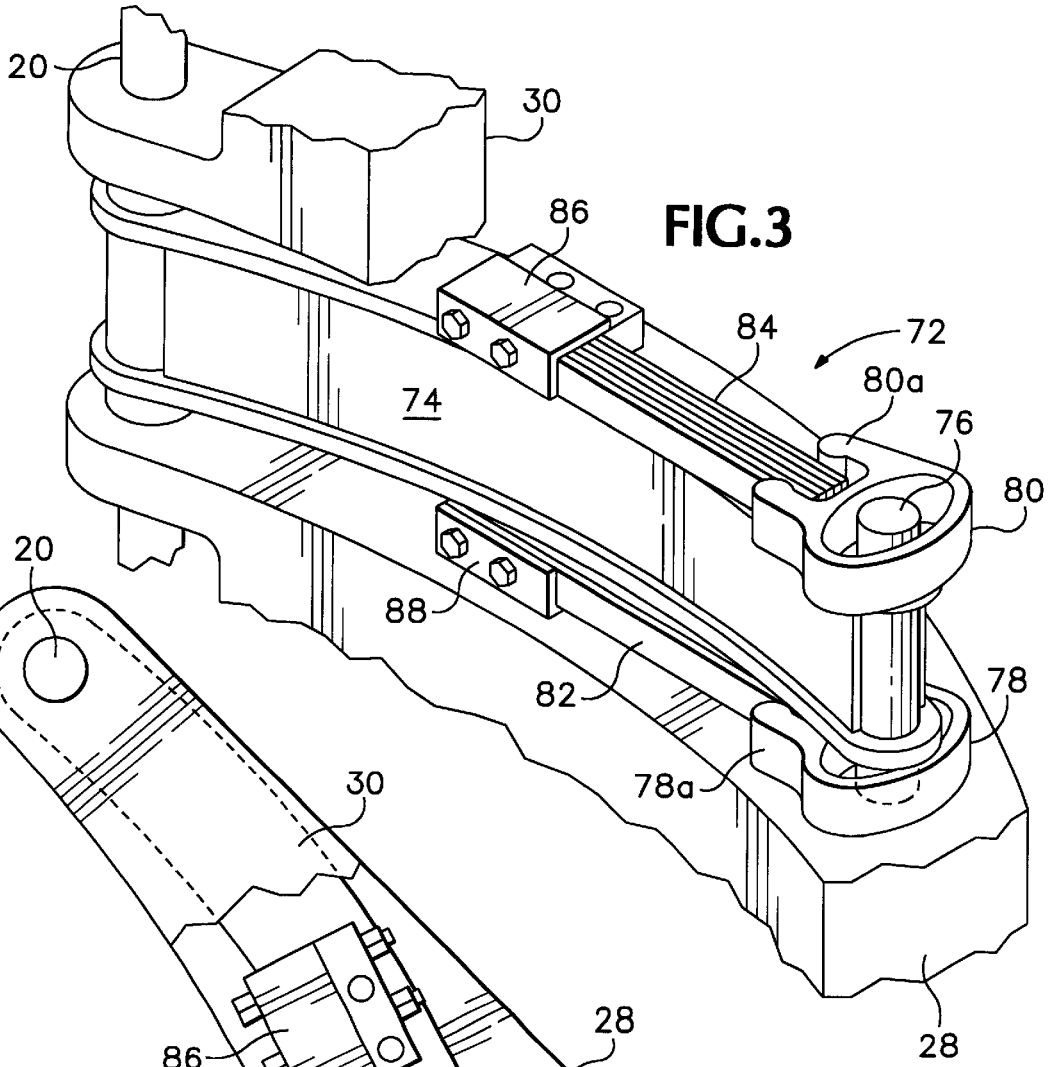
FIG. 3 is an enlarged partial perspective view of a pair of separately-actuated clamp arms used in the embodiment of FIG. 1, with an exemplary linkage mechanism therebetween in accordance with the present invention.

With reference to FIG. 3, a linkage mechanism indicated generally as 72 interconnects the pair of separately-actuated clamp arms 28 and 30. The linkage mechanism 72 preferably includes a linkage arm 74 pivotally connected to the frame 16, together with the clamp arms 28 and 30, at a common pivot pin 20. The linkage mechanism 72 preferably includes both a stop assembly which prevents more than a predetermined misalignment of the clamp arms 28 and 30 with respect to each other, and a spring assembly which imposes a yieldable biasing force which biases the pair of clamp arms toward alignment with each other.

Figure 4:
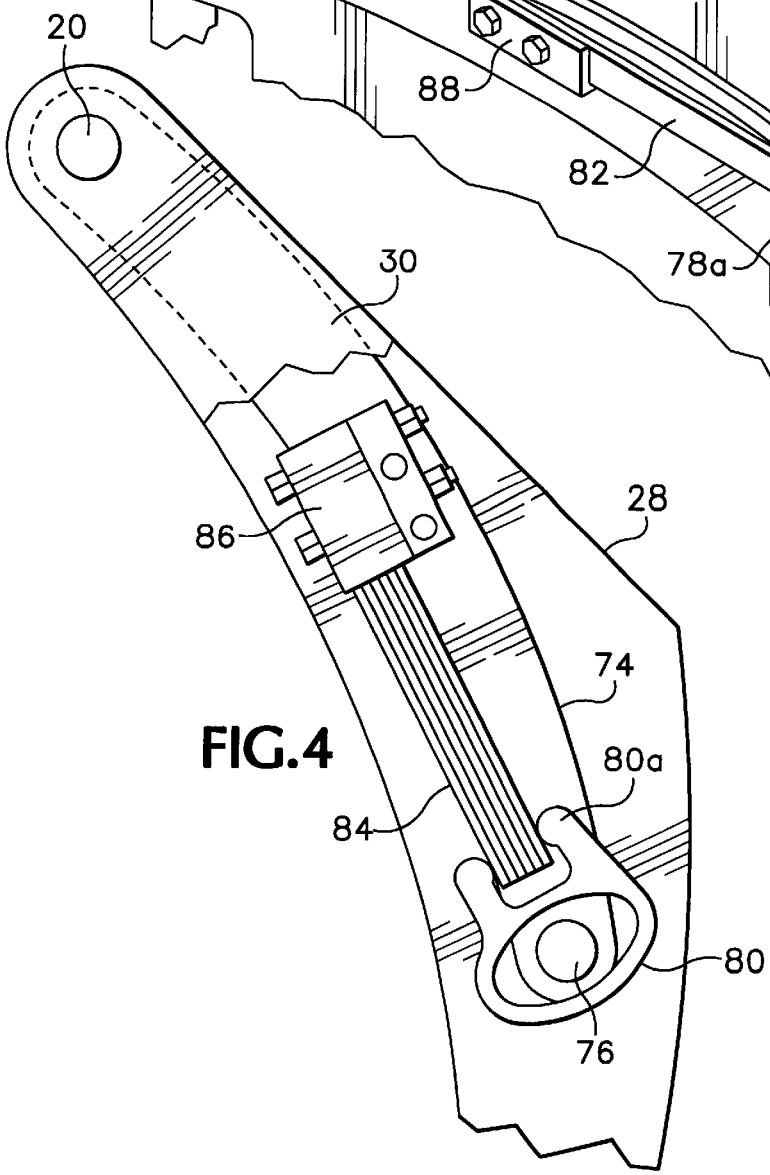
FIG. 4 is a partial top view of the clamp arms and linkage mechanism of FIG. 3, showing the clamp arms in aligned relationship to each other.
Figure 5:
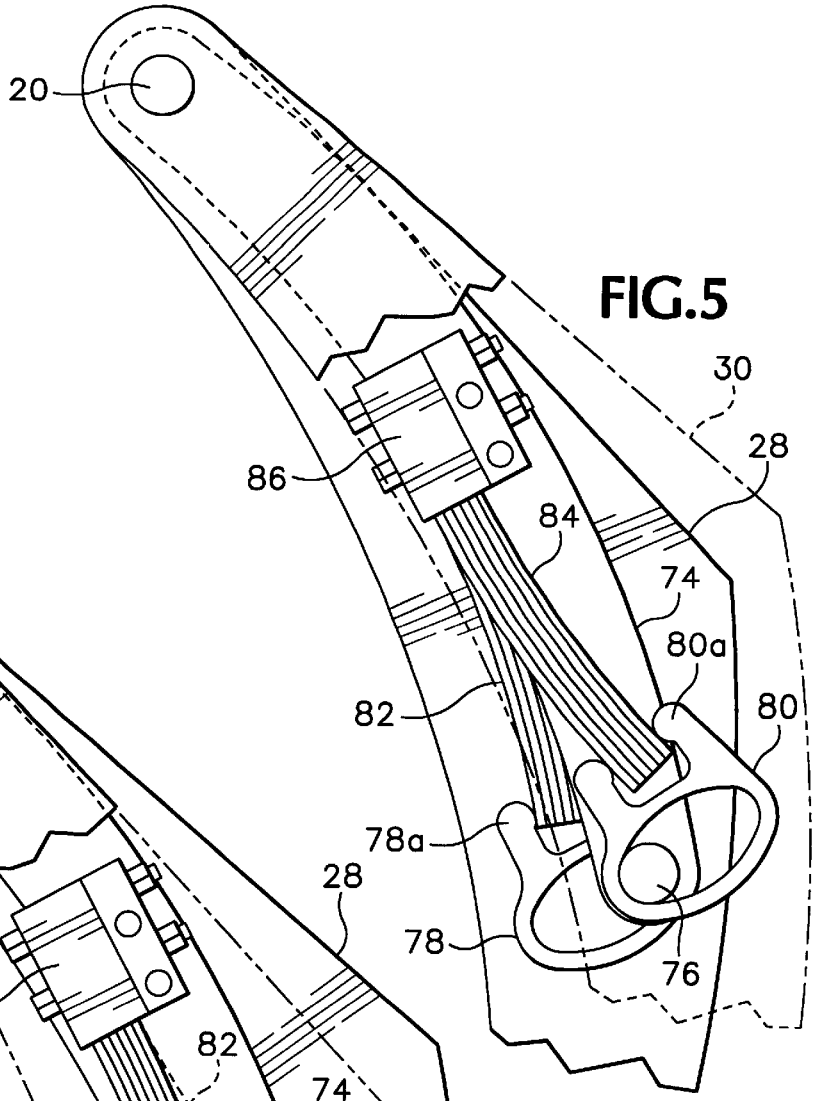
FIG. 5 is a figure similar to FIG. 4, but with the clamp arms at maximum misalignment in one direction.
Figure 6:
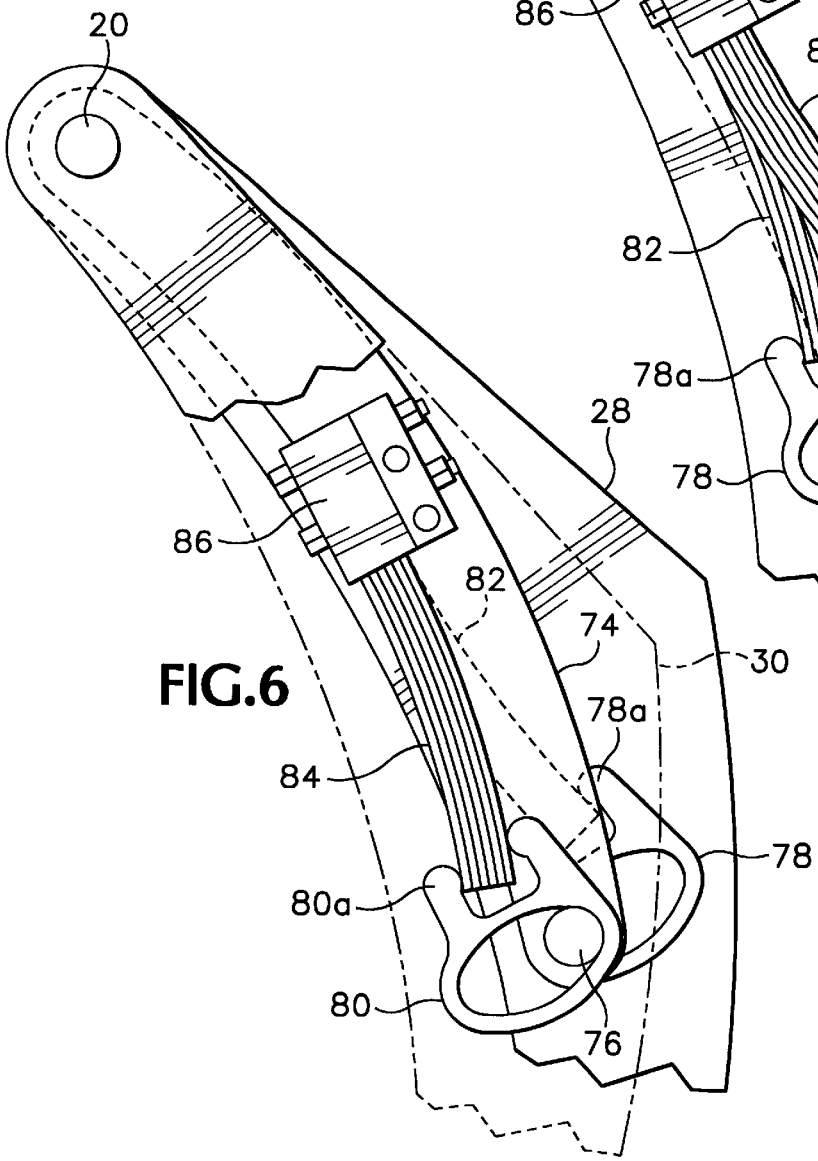
FIG. 6 is a figure similar to FIG. 5, but with the clamp arms at maximum misalignment in the opposite direction.

The stop assembly preferably includes a pin 76 affixed to the free end of the linkage arm 74, together with upper and lower pocket members 78 and 80, respectively, which are welded to the clamp arms 28 and 30 respectively and capture the ends of the pin 76 so that the movements of the pocket members 78 and 80 relative to the pin 76 are limited bidirectionally to predetermined limits. This arrangement thus prevents misalignment of the clamp arms 28 and 30 with respect to each other beyond the combined predetermined limits of the two pocket members 78 and 80. By way of example, FIG. 4 depicts the two clamp arms 28 and 30 in alignment with each other, with the pin 76 centered within each of the pocket members 78 and 80. In contrast, FIG. 5 shows the clamp arms misaligned with the arm 30 outwardly of the arm 28 to the predetermined limit permitted by the stop assembly, i.e. with the pocket member 80 abutting the pin 76 to the maximum outward extent while the pocket member 78 abuts the pin 76 to the maximum inward extent. Conversely, FIG. 6 depicts misalignment of the clamp arms to the same predetermined limit in the opposite direction, i.e. with the arm 28 outwardly of the arm 30. Instead of pin-and-pocket stops as shown, the stop assembly could utilize other types of stops, such as tether or balance beam links.

Assuming that rolls of different diameters corresponding to rolls 40 and 42 are to be engaged, pressurization of the cylinders 32 and 34 to close the clamp by moving the clamping assembly 24 toward the opposing clamping assembly 26 would usually cause the clamp arm 28 to be the first to encounter resistance due to the larger-diameter roll 40. Further closure of the clamp arms would cause clamp arm 30 to move further until it contacts the smaller-diameter roll 42 as shown in FIG. 1. The resultant misalignment of the clamp arms could not exceed the predetermined limit established by the stop assembly 76, 78, 80 as depicted in FIG. 6, which means that the difference in the diameters of the two rolls 40 and 42 should not exceed the difference in clamp arm misalignment permitted by the stop assembly.

If there were no upper roll 42, then the clamp arm 30 would advance inwardly until the misalignment of the clamp arms is at the maximum limit permitted by the stop assembly. At that point, because the stop assembly is strong enough to resist the operating clamping pressure in conduit 52, the clamping force produced by the upper clamping cylinder 34 would be transferred from the upper clamp arm 30 to the lower clamp arm 28 through the stop assembly, similarly to a solid arm construction with a standard hydraulic circuit. As an alternative, if using the adaptive pressure-limiting control system described previously to control the valve assembly 68, the sensed weight of the load is only approximately one-half of what it would be if the roll 42 were present, and therefore the operating clamping pressure in conduit 52 is reduced automatically in relation to the sensed load weight. Thus the stop assembly is particularly advantageous when used in conjunction with such an adaptive pressure-limiting control system.

It should be noted from FIGS. 5 and 6 that the linkage arm 74 always stays within the profile of both clamp arms 28 and 30 at maximum misalignment of the clamp arms in either direction. This means that the linkage arm 74 cannot strike and possibly damage a clamped paper roll under any clamping condition.

The above-described operation of the stop assembly avoids the drawbacks of highly misaligned clamp arms. However, it does not correct misalignment to prevent the combined clamp arms from presenting a thicker than normal clamp arm profile, which can damage a paper roll either inside or outside the clamp arms as the arms are inserted or withdrawn to engage or disengage a roll. This latter problem, however, is addressed by the spring assembly of the linkage mechanism 72. The spring assembly preferably comprises a pair of leaf springs 82 and 84 rigidly fastened at one end by spring anchors 86 and 88 to the upper and lower surfaces of the linkage arm 74. The opposite end of each leaf spring is pivotally captured within a respective clevis 78*a*, 80*a* of a respective pocket member 78, 80. Thus, whenever the clamp arms 28 and 30 are misaligned in either direction, as exemplified by FIGS. 5 and 6, the leaf springs 82 and 84 impose a yieldable biasing force biasing the pair of clamp arms toward alignment with each other as shown in FIG. 4. Alternatively, the biasing force could be provided by other types of springs, such as torsional or compression springs, utilized in the spring assembly.

The biasing force imposed by the spring assembly minimizes misalignment in two ways. First, the biasing springs are sized with suitable stiffness to resist any deviation from an initial aligned condition of the clamp arms 28 and 30 due merely to differences in frictional forces opposing movement of the clamp arms when they are moving toward or away from the clamping assembly 26. Second, when the clamp arms do become misaligned due to their engagement of different-sized loads or the imposition of other large external misaligning forces, the biasing force urges the arms back into alignment immediately when the arms are opened. This is because the hydraulic fluid seeks the path of least resistance during opening of the clamp arms which, due to the biasing force of the spring assembly, is the path which moves the innermost clamp arm outwardly into alignment with the outermost clamp arm. This realignment of the clamp arms to their narrowest profile occurs quickly and with minimum arm travel to avoid damaging adjacent paper rolls as the arms are withdrawn from a deposited load.

In other misalignment situations, the ability of the cylinders 32 and 34 to exchange fluid through a transfer conduit assembly comprising conduits 55 and 56 enables rapid realignment of the clamp arms even though the control valve 48 may be closed thereby blocking the exhaust of fluid from the cylinders 32 and 34. Such transfer of fluid between the cylinders through the transfer conduit assembly 55, 56 in response to the biasing force is accompanied by an opposite fluid transfer through a conduit 90 interconnecting the opposite ends of the cylinders. Such fluid transfer through conduits 55, 56 would not be possible if a pilot-operated check valve such as 62 were interposed in each of the conduits 55 and 56, as is customary. However, in such case an alternative transfer conduit assembly could be provided by interconnecting a further conduit between the two cylinders in parallel with the conduits 55 and 56.

Although the use of a linkage arm such as 74 interconnected with adjacent clamp arms by respective pairs of stops and springs is preferred, the linkage arm 74 could be eliminated and replaced with single stops and/or springs interconnecting the adjacent clamp arms.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of fluid power actuators, each associated with a respective one of said pair of clamp arms, for moving said clamp arms selectively toward and away from the second clamping assembly;

(d) a fluid conduit connected to said pair of fluid power actuators so as to urge said actuators to move said clamp arms simultaneously toward said second clamping assembly by the maintenance of fluid pressure in said conduit;

(e) a linkage mechanism interconnecting said pair of clamp arms so as to permit relative movement therebetween to enable said clamp arms to move asynchronously toward said second clamping assembly, said linkage mechanism including a stop assembly preventing more than a predetermined misalignment of said clamp arms with respect to each other, and including a spring assembly imposing a yieldable biasing force biasing said pair of clamp arms toward alignment with each other.

2. The apparatus of claim 1 wherein said linkage mechanism comprises a linkage arm movable with said clamp arms and connected between said clamp arms.

3. The apparatus of claim 2 wherein said linkage arm and said pair of clamp arms are each pivotally connected separately to said frame.

4. The apparatus of claim 2 wherein said spring assembly comprises a pair of springs, each interconnecting said linkage arm with a respective one of said clamp arms.

5. The apparatus of claim 4 wherein each of said springs imposes said yieldable biasing force bidirectionally.

6. The apparatus of claim 2 wherein said stop assembly comprises a pair of stops, each interconnecting said linkage arm with a respective one of said clamp arms.

7. The apparatus of claim 6 wherein each of said stops opposes said misalignment bidirectionally.

8. The apparatus of claim 1 including a fluid transfer conduit assembly interconnecting said pair of fluid power actuators so as to permit the transfer of fluid between said actuators in response to said biasing force imposed by said spring assembly.

9. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of fluid power actuators, each associated with a respective one of said pair of clamp arms, for moving said clamp arms selectively toward and away from the second clamping assembly;

(d) a fluid conduit connected to said pair of fluid power actuators so as to urge said actuators to move said clamp arms simultaneously toward said second clamping assembly by the maintenance of fluid pressure in said conduit;

(e) a linkage mechanism interconnecting said pair of clamp arms so as to permit relative movement therebetween to enable said clamp arms to move asynchronously toward said second clamping assembly, said linkage mechanism including a stop assembly preventing more than a predetermined misalignment of said clamp arms with respect to each other;

(f) said linkage mechanism including a linkage arm movable with said clamp arms and connected between said clamp arms, said stop assembly comprising a pair of stops, each interconnecting said linkage arm with a respective one of said clamp arms.

10. The apparatus of claim 9 wherein each of said stops opposes said misalignment bidirectionally.

11. The apparatus of claim 9 wherein said linkage arm and said pair of clamp arms are each pivotally connected separately to said frame.

12. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of fluid power actuators, each associated with a respective one of said pair of clamp arms, for moving said clamp arms selectively toward and away from the second clamping assembly;

(d) a fluid conduit connected to said pair of fluid power actuators so as to urge said actuators to move said clamp arms simultaneously toward said second clamping assembly by the maintenance of fluid pressure in said conduit;

(e) a linkage mechanism interconnecting said pair of clamp arms so as to permit relative movement therebetween to enable said clamp arms to move asynchronously toward said second clamping assembly, said linkage mechanism including a spring assembly imposing a yieldable biasing force biasing said pair of clamp arms toward alignment with respect to each other;

(f) said linkage mechanism including a linkage arm movable with said clamp arms and connected between said clamp arms, said spring assembly comprising a pair of springs, each interconnecting said arm with a respective one of said clamp arms.

13. The apparatus of claim 12 wherein each of said springs imposes said yieldable biasing force bidirectionally.

14. The apparatus of claim 12 wherein said linkage arm and said pair of clamp arms are each pivotally connected separately to said frame.

15. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of fluid power actuators, each associated with a respective one of said pair of clamp arms, for moving said clamp arms selectively toward and away from the second clamping assembly;

(d) a fluid conduit connected to said pair of fluid power actuators so as to urge said actuators to move said clamp arms simultaneously toward said second clamping assembly by the maintenance of fluid pressure in said conduit;

(e) a linkage mechanism interconnecting said pair of clamp arms so as to permit relative movement therebetween to enable said clamp arms to move asynchronously toward said second clamping assembly, said linkage mechanism including a spring assembly imposing a yieldable biasing force biasing said pair of clamp arms toward alignment with respect to each other;

(f) a fluid transfer conduit assembly interconnecting said pair of fluid power actuators so as to permit the transfer of fluid between said actuators in response to said biasing force imposed by said spring assembly.

16. A load-handling clamp adapted to be mounted upon the lifting apparatus of a lift truck, comprising:

(a) a frame adapted to be mounted upon said lifting apparatus so as to be selectively movable vertically by said lifting apparatus;

(b) first and second selectively openable and closable opposing clamping assemblies mounted upon said frame, the first clamping assembly comprising at least a pair of clamp arms movable separately from each other relative to said frame selectively toward and away from the second clamping assembly;

(c) a pair of fluid power actuators, each associated with a respective one of said pair of clamp arms, for moving said clamp arms selectively toward and away from the second clamping assembly;

(d) a fluid conduit connected to said pair o f fluid power actuators so as to urge said actuators to move said clamp arms simultaneously toward said second clamping assembly by the maintenance of fluid pressure in said conduit;

(e) a pressure-limiting valve assembly connected to said pair of fluid power actuators capable of limiting said fluid pressure to variable operating pressures automatically dependent upon the weight of a load clamped between said opposing clamp assemblies; and (f) a linkage mechanism interconnecting said pair of clamp arms so as to permit relative movement therebetween to enable said clamp arms to move asynchronously toward said second clamping assembly, said linkage mechanism including a stop assembly preventing more than a predetermined misalignment of said clamp arms with respect to each other and capable of resisting any of said variable operating pressures.

* * * * *